United States Patent [19]

Satoh

[11] Patent Number: 4,516,463

[45] Date of Patent: May 14, 1985

[54] KEY MECHANISM FOR WIND INSTRUMENTS

[75] Inventor: Fusao Satoh, Shizuoka, Japan

[73] Assignee: Nippon Gakki Seizo Kabushiki Kaisha, Japan

[21] Appl. No.: 539,525

[22] Filed: Oct. 6, 1983

[30] Foreign Application Priority Data

Oct. 7, 1982 [JP] Japan ..... 57-176583

[51] Int. Cl.[3] ..... G10D 7/08

[52] U.S. Cl. ..... 84/385 R

[58] Field of Search ..... 84/380 R, 382, 385 R, 84/385 P

[56] References Cited

U.S. PATENT DOCUMENTS 1,610,207 12/1926 Hilton ..... 84/385 R 3,941,026 3/1976 Hildebrandt ..... 84/382

*Primary Examiner*—Benjamin R. Fuller

*Attorney, Agent, or Firm*—Ostrolenk, Faber, Gerb & Soffen

[57] ABSTRACT

In the construction of a key mechanism for wind instruments such as woodwind pad cups for two different tone holes are mounted to separate hinge rods by different keys which are separately spring biased for easy construction and adjustment of the mechanism with reliable protection of air leak at closing of the tone holes by the pad cups.

2 Claims, 3 Drawing Figures

KEY MECHANISM FOR WIND INSTRUMENTS

BACKGROUND OF THE INVENTION

The present invention relates to an improved key mechanism for wind instruments, and more particularly relates to an improvement in construction of a key mechanism for woodwinds such as baritone saxophones in which two register holes are simultaneously closed by a lever action on pad cups.

A big and long woodwind such as a baritone saxophone is often provided with two middle tone holes formed in the body in order to enable easy generation of harmonics of the middle tones for rich tone colour effect. In this case, both tone holes have to be closed and opened simultaneously and reliably in order to avoid dull generation of tones. A key mechanism including a pair of pad cups, i.e. hole covers, is in general arranged on the body of a woodwind for control of such action on the tone holes.

Conventionally, such pad cups are mounted to a hinge rod on the body of the woodwind by means of an angled key so that, upon swing of the key caused by axial rotation of the hinge rod, the pad cups should close or open the associated tone holes. With this conventional construction, however, use of a single key for two pad cups is accompanied with several drawbacks. First, possible production error of the pad cups, variation in thickness of soft pads attached to the pad cups and timefunctional change in thickness of the soft pad on each pad cup tend to concur to disenable complete closing of the tone holes, thereby causing air leakage which connects to dull generation of tones. Second, adjustment in thickness of the soft pads and/or in mounting of the pad cups in general requires highly skilled operators and long time, which connect to lowering in productivity.

SUMMARY OF THE INVENTION

It is the primary object of the present invention to provide a key mechanism for wind instruments which well avoids air leakage at closing of the tone holes.

It is another object of the present invention to provide a key mechanism for wind instruments which can be constructed and adjusted very easily.

In accordance with the basic aspect of the present invention, first and second pad cups for different tone holes are mounted to the body of a wind instrument by means of first and second keys, respectively, the first key is biased for closing by a spring attached to the second key, and the second key is biased for closing by a separate spring.

DESCRIPTION OF THE PREFERRED EMBODIMENTS

Figure 1:
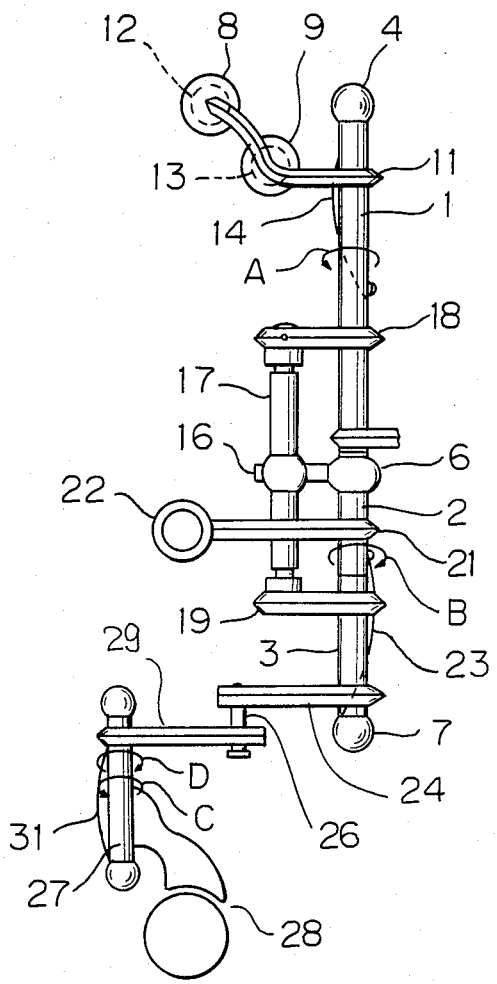
Fig. 1 PRIOR ART
FIG. 1 is an extended view of the conventional key mechanism for woodwinds.

One example of the conventional key mechanism for woodwinds is shown in an extended fashion in FIG. 1.

Three hinge rods 1,2 and 3 are axially rotatably arranged on the body (not shown) of a woodwind by means of fixed posts 4,6 and 7 secured to the body. Two pad cups 8 and 9 are coupled to the upper hinge rod 1 by means of a common angled key 11 which extends in one radial direction of the upper hinge rod 1. A needle spring 14 is attached to the upper hinge rod 1 which urges the upper hinge rod to axially rotate in the direction of an arrow A so that, under the normal condition, the pad cups 8 and 9 should close associated tone holes 12 and 13 formed in the body.

A pin 16 extends radially from the intermediate hinge rod 2 and a seesaw lever 17 is pivoted at about its middle to the pin 16 parallel to the upper and intermediate hinge rods 1 and 2. One end of the seesaw lever 17 is coupled to the upper hinge rod 1 by means of a radial arm 18 and the other end to the lower hinge rod 3 by means of another radial arm 19.

A treble key 21 extends radially from the intermediate hinge rod 2 and holds a pad cup 22 for closing a treble tone hole (not shown) formed in the body of the woodwind. To this end, a needle spring 23 is attached to the intermediate hinge rod 2 in order to urge the intermediate hinge rod 2 to rotate in the direction of an arrow B so that, under the normal condition, the pad cup 22 should close the treble tone hole.

The lower hing rod 3 is accompanied with a radially extending octave arm 24 which holds a pin 26 parallel to the lower hinge rod 3. A shaft 27 for an octave lever 28 is held parallel to the pin 26 by a pair of fixed posts and coupled to the pin 26 by means of another octave arm 29. That is, the pin 26 is received in a recess formed in the end of the octave arm 29. The shaft 27 is urged by an attached needle spring 31 to rotate in the direction of an arrow C. The spring force of the needle spring 31 for the shaft 27 is designed larger than that of the needle spring 23 for the intermediate hinge rod 2.

For generation of the middle tones, the octave lever 28 is manually depressed so that the shaft 27 should rotate in the direction of an arrow D against the force of the needle spring 31. Accompanied swing of the second octave arm 29 presses down the pin 26 and, due to the coupling by the first octave arm 24, the lower hinge rod 3 is forced to rotate in a direction opposite to the arrow B. Upon this rotation of the lower hinge rod 3, the radial arm 19 swings downwards and the seesaw lever 17 swings about the pin 16. Resultant lift of the other end of the seesaw lever 17 raises the associated end of the radial arm 18.

Following this swing of the radial lever 18, the upper hinge rod 1 is forced to rotate in a direction opposite to the arrow A against the force by the needle spring 14. As a consequence, the key 11 swings upwards and moves the pad cups 8 and 9 upwards in order to open the associated middle tone holes 12 and 13.

As already described briefly, use of a common, single key 11 for the two pad cups 8 and 9 is accompanied with air leak and productivity troubles.

Figure 2:
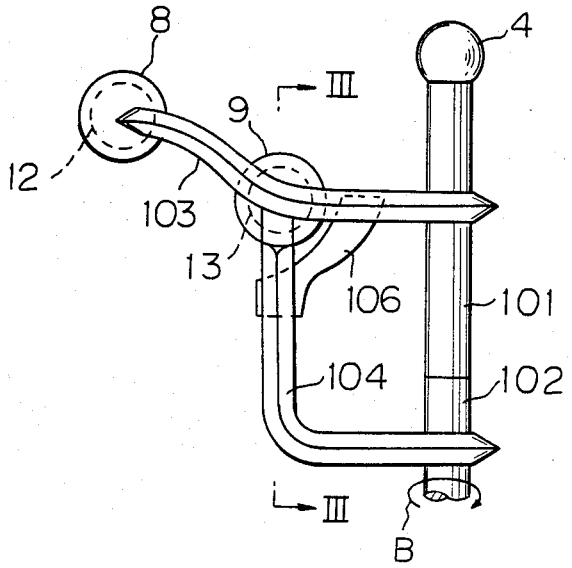
FIG. 2 is an extended view of the main part of one embodiment of the key mechanism in accordance with the present invention.
Figure 3:
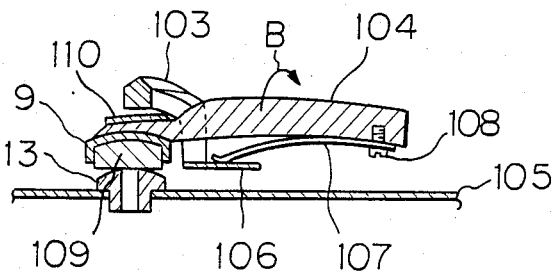
FIG. 3 is a section taken along the line III—III in FIG. 2.

One embodiment of the key mechanism in accordance with the present invention is shown in FIGS. 2 and 3, in which elements substantially same in construction and operation as those used for the above-described conventional construction are indicated with same reference numerals. Further, elements not directly related to the invention are omitted in the illustration for simplification purposes.

Like the conventional construction, this key mechanism includes the first and second pad cups 8 and 9 for the first and second middle tone holes 12 and 13 formed in the body 105 of the wind instrument. The key mechanism further includes two hinge rods 101 and 102 in axial alignment. The second hinge rod 102 corresponds to the upper hinge rod 1 shown in FIG. 1 and spring biased in the direction of the arrow A. The first hinge rod 101 is arranged between the second hinge rod 102 and the fixed post 4.

The first pad cup 8 for the first tone hole 2 is held by a first curved key 103 whose proximal end is secured to the first hinge rod 101. Whereas the second pad cup 9 for the second tone hole 13 is held by a second angle key 104 whose proximal end is secured to the second hinge rod 102. The second pad cup 9 is located below the middle of the first key 103.

A horizontal tongue 106 is attached to the bottom of the first key 103 at a position near the proximal end of the latter. This tongue 106 is somewhat curved downwards and its distal end is located below the second key 104 at a position near the distal end of the latter. As best seen in FIG. 3, a leaf spring 107 is fixed at one end to the bottom of the second key 104 by means of a set screw 108 and the other end of this leaf spring 107 bears on the distal end of the tongue 106. As a result, the tongue 106 is always resiliently pressed downwards and the first key 103 is urged to rotate in the direction of the arrow A so that, under the normal condition, the first pad cup 8 should close the first tone hole 12.

As described already, the second hinge rod 1 corresponds to the upper hinge rod 1 in FIG. 1 and is spring biased so as to rotate in the direction of the arrow A, too. As a consequence, the second pad cup 9 normally closes the second tone hole 13 due to the coupling to the second hinge rod 102 by the second key 104.

As the octave lever 28 is manually depressed (see FIG. 1), the radial arm 18 is moved upwards by the coupling end of the seesaw lever 17 and the second hinge rod 102 rotates in a direction opposite to the arrow A against the force by the needle spring 14. This rotation of the second hinge rod 102 move the second key 104 upwards and the second pad cup 9 opens the second tone hole 13. In FIG. 3, a pad 109 held by the second pad cup 9 separates from the tone hole 13. As described already, the distal end of the second key 104 holding the second pad cup 9 of located below about the middle of the first key 103. Therefore, as the second key 104 swings upward, the first key 103 is automatically pushed upwards via a felt piece 110 and the first pad cup 8 opens the first tone hole 12 concurrently with opening of the second tone hole 13 by the second pad cup 9.

In the case of the foregoing embodiment, the first key 103 is urged to close the tone hole 12 by the force of the leaf spring 107 atatched to the second key 104 in pressure contact with the tongue 106 extending from the first key 103. As an alternative, an ordinary spring may be attached directly to the first key 103 in a known manner.

In accordance with the present invention, different pad cup 8 and 9 are held by different keys 103 and 104 coupled to different hinge rods 101 and 102 and are urged to close the associated tone holes 12 and 13 by operation of different springs 107 and 14. As a consequence, production error of one pad cup, variation in thickness of the soft pad attached to the one pad cup and timefunctional change in thickness of the soft pad on the one pad cup have no influence on the operation of the other pad cup. The key mechanism can be constructed and adjusted very easily without need for high technique. The separate spring biasing against the keys assure complete closing of the tone holes without the danger of air leak. In addition to rise in productivity, function of the key mechanism can be maintained very stably over a long period.

I claim:

1. An improved key mechanism for wind instruments in which first and second tone holes formed in the body of a wind instrument are simultaneously closed and opened by a lever action, a first hinge rod axially rotatably arranged on said body, a second hinge rod arranged on said body and driven for axial rotation by said lever action, a first key fixed to said first hinge rod and holding a first pad cup for said first tone hole, a second key fixed to said second hinge rod and holding a second pad cup for said second tone hole, and a spring means attached to said second key and biasing said first key so that said first pad cup should close said first tone hole, the operation of said lever action permitting said second key to raise said first pad cup apart from said first tone hole.

2. An improved key mechanism as claimed in claim 1 in which said spring is a leaf spring fixed at one end to the bottom of said second key and bearing at the other end against the top surface of a tongue extending from said first key.

* * * * *